US005310393A

United States Patent [19]

Highsmith et al.

[11] Patent Number: 5,310,393

[45] Date of Patent: May 10, 1994

[54] T-BAR ROW EXERCISE DEVICE

[75] Inventors: Gregory R. Highsmith, West Hampton Beach, N.Y.; Carl K. Towley, III, Owatonna, Minn.

[73] Assignee: Lumex, Inc., Bay Shore, N.Y.

[21] Appl. No.: 56,473

[22] Filed: May 3, 1993

Related U.S. Application Data

[63] Continuation-in-part of Ser. No. 906,514, Jun. 30, 1992, abandoned.

[51] Int. Cl.[5] ..... A63B 21/06

[52] U.S. Cl. ..... 482/93; 462/97; 462/146

[58] Field of Search ..... 482/93, 72, 92, 133, 482/97, 80, 100, 137, 148

[56] References Cited

U.S. PATENT DOCUMENTS

| | | | |
|---|---|---|---|
| 2,932,509 | 4/1960 | Zinkin | 482/97 |
| 3,588,101 | 6/1971 | Jungreis | 482/97 X |
| 4,344,619 | 8/1982 | Szabo . | |
| 4,407,495 | 10/1983 | Wilson | 482/97 |
| 4,572,505 | 2/1986 | Kornhaus . | |
| 4,657,245 | 4/1987 | Smith . | |
| 4,722,522 | 2/1988 | Lundgren | 482/97 |

OTHER PUBLICATIONS

Body Culture Equipment Catalog, in "Iron Man", vol. 44, No. 4, pp. 4, 5, 9, 88 & 96-98, May, 1985.

Atlantic Fitness Products Catalog, Nov. 1, 1985, pp. 24 & 29.

*Primary Examiner*—Richard J. Apley
*Assistant Examiner*—Beverly A. Meindl
*Attorney, Agent, or Firm*—John W. Bunch

[57] ABSTRACT

An improved T-bar row exercise device (10) includes a pivot bar (20) with an intermediate transverse weight tube (40) located behind the handle (32) and footrests (28) in order to minimize inertial effects for smoother motion, better form and more effective training by the user. If desired, the weight tube (40) can be mounted in a raised position to provide more proportional resistance over the lift angle.

20 Claims, 2 Drawing Sheets

T-BAR ROW EXERCISE DEVICE

CROSS REFERENCE TO RELATED APPLICATION

This application is a continuation-in-part of application Ser. No. 906,514 filed Jun. 30, 1992, now abandoned.

TECHNICAL FIELD

The present invention relates generally to exercise devices. More particularly, this invention concerns an improved exercise device of the T-bar row type for exercising the deltoid muscles.

BACKGROUND

Various exercises have been devised for developing muscles in the shoulders and back for upper body training, such as deltoid muscles. For example, this can be done with a bar bell by putting one end on the floor in a corner, placing weights only on the other end, gripping that end and pulling upward from a straddle position in the desired number of repetitions. This is a somewhat makeshift approach, however. Exercise devices specifically adapted for this purpose have been available heretofore. Such so called T-bar row exercise devices generally include a bar which is securely pivoted at one end, with a handle mounted near the outer end on which the weights can be placed. Such devices are used from a similar straddle position. Foot rests are sometimes provided to assist the exerciser in maintaining proper form. However, because of the placement of weight at the outer end of the pivot bar, there tends to be a fair amount of inertia developed when using either of these approaches, especially when the repetitions are done rapidly, whereby impact occurs with the chest of the user. The user effectively becomes the stop for the pivot bar, but this makes it difficult to do the exercise with smooth motion while maintaining proper form for most effective training.

There has been a long standing need for an improved T-bar row exercise device which allows for smooth motion without such adverse inertial effects.

SUMMARY OF INVENTION

The present invention comprises an improved T-bar row exercise device which overcomes the foregoing and other difficulties associated with the prior art. In accordance with the invention, there is provided an improved exercise device of the T-bar row type which is configured to minimize inertial effects from the weight for smoother motion and more effective training. The improved T-bar row exercise device herein includes a frame, a longitudinal bar pivoted at one end to the frame, a handle near the other end of the bar, and a transverse weight tube on the bar behind the handle for selectively receiving one or more free weights thereon acting as the primary resistance. The frame also includes a pair of foot rests located between the handle and the transverse weight tube, and stops for the down or lowered position of the pivot bar. This configuration minimizes adverse inertial effects. If desired, a weight peg can be provided on the outer end of the pivot bar for adding secondary weights for additional resistance. The handle can also be adjustable.

If desired, the transverse weight tube can be mounted in a raised position along the pivot bar for even more effective training.

BRIEF DESCRIPTION OF DRAWING

A better understanding of the invention can be had by reference to the following detailed description in conjunction with the accompanying drawing, wherein.

DETAILED DESCRIPTION

Figure 1:
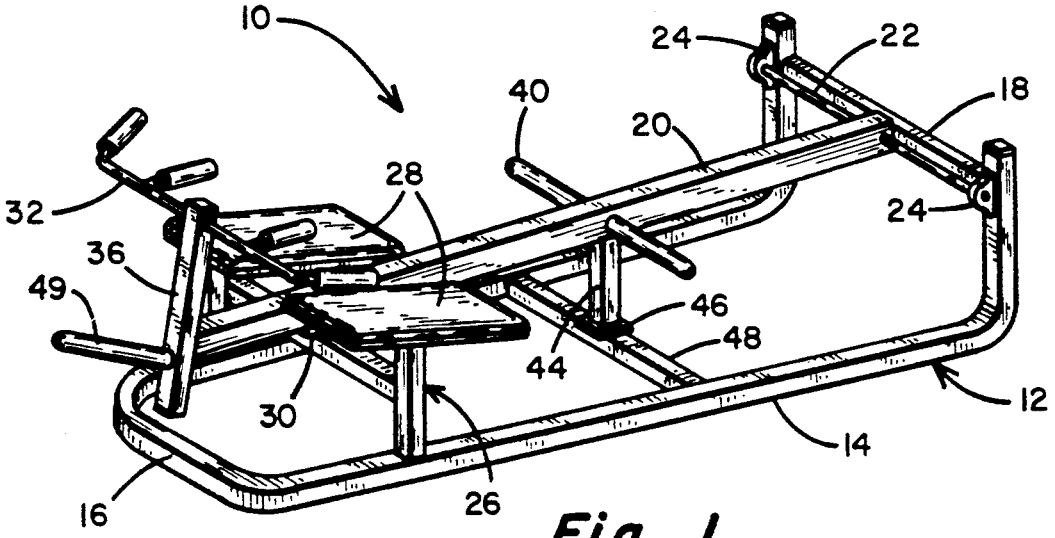
FIG. 1 is a perspective view of the improved T-bar row exercise device of the invention.

Referring now to the drawing, wherein like reference numerals designate like or corresponding elements throughout the views, there is shown an improved T-bar row exercise device 10 comprising the invention. As will be explained more fully hereinafter, the exercise device 10 is designed to reduce inertial effects for smoother motion, better form and technique during exercise, and thus more effective training.

The exercise device 10 includes a frame 12 including a pair of longitudinal side members 14, a front member 16, and a rear member 18. In the preferred embodiment, members 14 and 16 are constructed from a single piece of stock formed as shown. The rear ends of side members 14 are turned upwardly, and the rear cross member 18 is secured therebetween. The frame 12 can be constructed entirely from steel tube sections welded together. The frame 12 is preferably somewhat wider at the rear, as best seem in FIG. 2, to enhance stability. The frame 12 is adapted to be free standing on a floor.

A longitudinal pivot bar 20 is mounted on the frame 12. In particular, the rear end of bar 20 is secured to a shaft 22 which is journaled for rotation between bearings 24 on the upturned rear ends of the side members 14 of frame 12.

A subframe 26 is located near the front of frame 12. A pair of foot rests 28 are provided on the subframe 26. The foot rests 28 are preferably angled rearwardly and include skid resistant surfaces.

The foot rests 28 can be angled at about 10–15 degrees, for example. The pivot bar 20 extends between the footrests 28 in contact with a pad 30 on an underlying transverse portion of the subframe 26.

A handle 32 is provided near the front end of pivot bar 20. The handle 22 includes at least two grips and may be either fixed or adjustable. As shown, the handle 32 includes a pair of outer diagonal grips and a pair of inner longitudinal straight grips spaced symmetrically about the pivot bar 20. FIG. 1 shows the handle 32 as being fixed.

Figure 2:
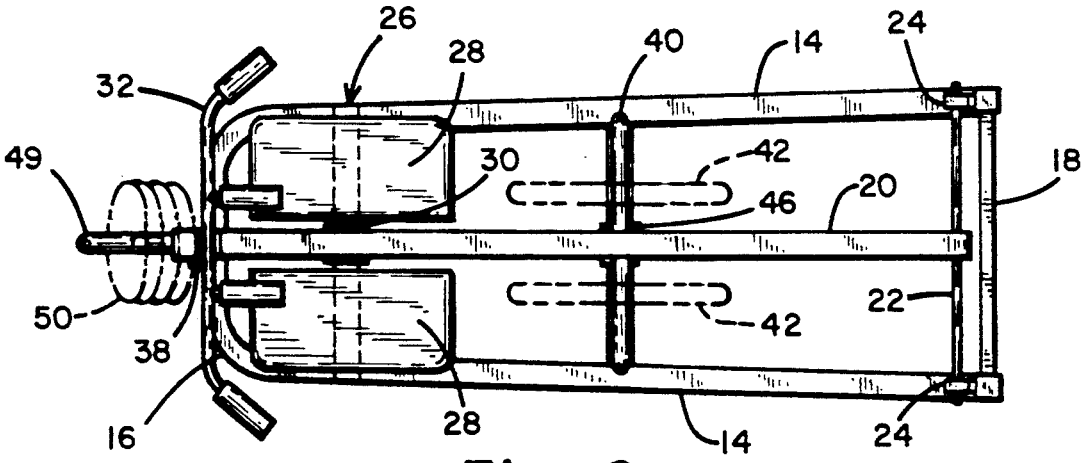
FIG. 2 is a top view thereof, showing the option of an adjustable handle.
Figure 3:
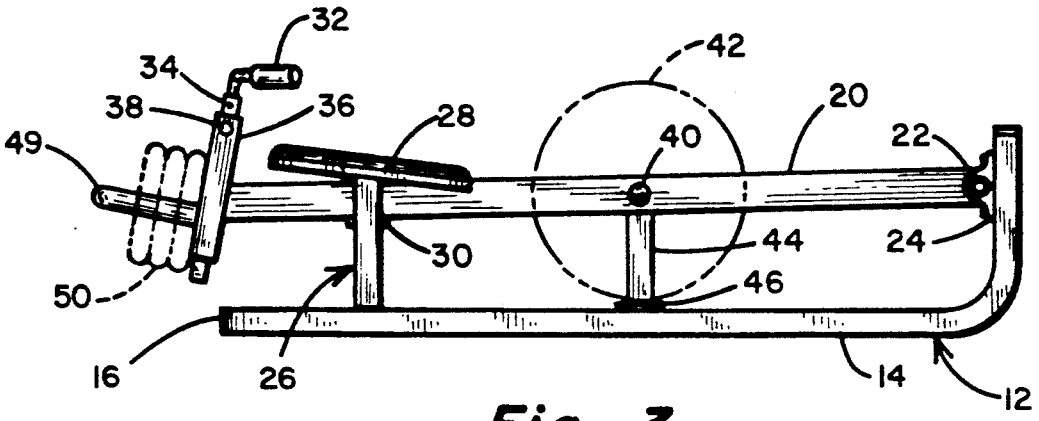
FIG. 3 is a side view thereof.

If desired, an adjustable mounting can be provided for the handle 32. FIGS. 2 and 3 show the handle 32 mounted on a post 34 which is slidably received in a guide 36 attached to the pivot bar 20. A manual detent spring pin 38 on the guide 36 selectively engages one of the holes in post 34 in order to provide adjustability for the particular user.

A transverse weight tube 40 is also provided in the pivot bar 20 between foot rests 28 and shaft 22. Free weights 42 can be positioned on the weight tube 40 to provide the desired resistance. The location of weight tube 40 comprises a significant feature of the present invention. A person using the exercise device 10 stands on footrests 28 with knees bent and back straight, gripping handle 32. The primary resistance is thus behind the person exercising. Since the weights 42 on the weight tube 40 are relatively closer to the fulcrum of pivot bar 20, more weight must be used to obtain the same resistance; however, the weight travels over a shorter more linear path so that the inertial effects are less. This in turn allows for smoother motion so that the person exercising can do the number of desired repetitions while maintaining proper form without jarring.

A brace 44 is provided on the pivot bar 20 beneath the transverse weight tube 40. The brace 44 extends downwardly into contact with a pad 46 on a cross member 48 secured between the side members 14 of frame 12. In the preferred abodiment, the pivot bar 20 is thus supported at two points in its normal down or lowered position.

If desired, a peg 49 can be provided on the end of pivot bar 20 for selectively receiving relatively smaller secondary weights 50 for additional resistance.

Figure 4:
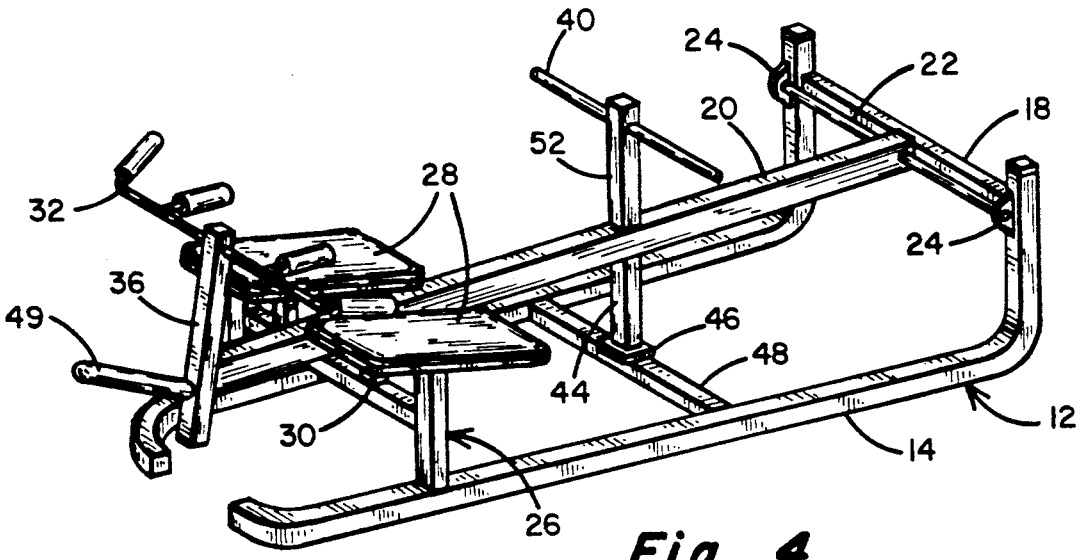
FIGS. 4 and 5 are perspective and side views, respectively, showing a modification of the invention.
Figure 5:
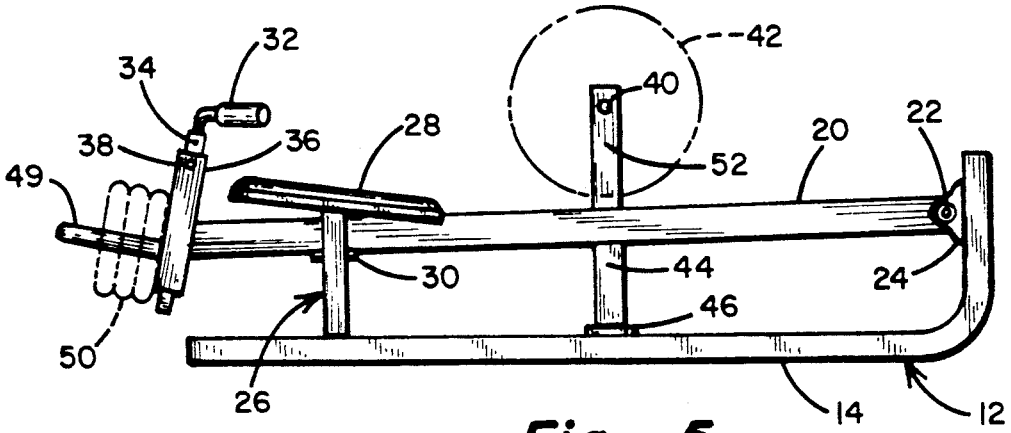

FIGS. 4 and 5 show a modified T-bar row exercise device 10 incorporating a raised mount 52 for the transverse weight tube 40. As shown, the transverse weight tube 40 is positioned about 9.5 inches above the axis of the pivot bar 20. This allows the free weights 42 to be located above the pivot bar 20, which in turn results in a different rate of change in the resistance that is more proportional to the users strength. This proportional resistance further enhances more effective training with the exercise device 10.

Figure 6:
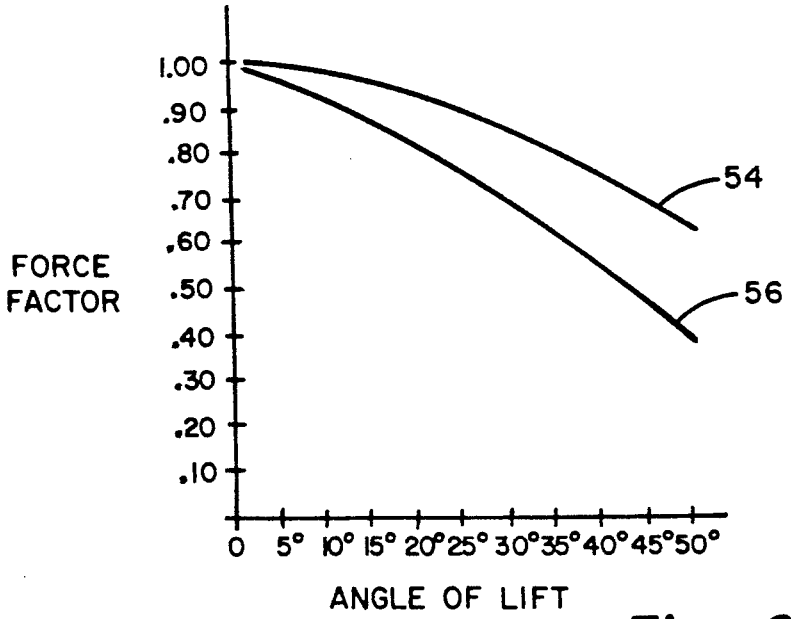
FIG. 6 is a graph illustrating the resistance forces of the original and modified versions of the invention, as a function of lift angle of the pivot bar.

FIG. 6 illustrates the comparative resistances of the exercise device 10 and modified exercise device herein, as a function of the lift angle of pivot bar 20. Force factor is the percentage of original weight at a starting angle of 0 degrees felt by a user over the angle of lift of pivot bar 20. The resistance felt by a user is a function of the mass being moved, gravity, and the direction the mass is moved. This can be expressed as follows:

$$R = K \times m \times g \times \text{cosine (initial angle} + \text{lift angle)}$$

where:

R = resistance

K = constant reflecting lever action m = mass g = gravitational constant

Since the force factor is also inversely proportional to the angle of lift, it can thus be seen that when the initial starting angle is 0, as in the case of the exercise device shown in FIGS. 1 and 2, the force factor is represented by line 54 in FIG. 6. However, when the initial starting angle is something greater than 0, such as 18 degrees, as in the case of the modified device shown in FIGS. 4 and 5, then the force factor will vary differently as represented by line 56 in FIG. 6. In other words, the effective resistance of the modified exercise device 10 of FIGS. 4 and 5 decreases more quickly as lift angle increases. This comprises a significant improvement to the present invention.

From the foregoing it will thus be apparent that the present invention comprises an improved T-bar row exercise device having several advantages over the prior art. A significant advantage is that location of the primary resistance behind the user reduces inertial effects and facilitates better training. Other advantages will be evident to those skilled in the art.

Although particular embodiments of the invention have been illustrated in the accompanying drawing and described in the foregoing detailed description, it will be understood that the invention is not limited only to the embodiments disclosed, but is intended to embrace any alternatives, equivalents, modifications and/or rearrangements of elements falling within the scope of the invention as defined by the following claims.

What is claimed is:

1. An exercise device of the T-bar row type, which comprises:

a frame having front and rear ends;

an elongate pivot bar having opposite ends;

means for pivotally securing one end of said pivot bar to the rear end of said frame for pivotal movement in a vertical plane between lowered and raised positions;

a handle secured to the other end of said pivot bar;

a transverse weight tube secured to said pivot bar between said handle and the rear end of said frame, said weight tube being adapted for receiving at least one free weight thereon;

a pair of laterally spaced apart footrests associated with said frame and disposed on opposite sides of said pivot bar between said handle and said transverse weight tube; and means for normally supporting said pivot bar in the lowered position.

2. The exercise device of claim 1, wherein the rear end is relatively wider than the front end of said frame.

3. The exercise device of claim 1, wherein said means for pivotally securing one end of said pivot bar to said frame comprises:

a pair of laterally spaced apart bearings secured to said frame; and a cross shaft secured to said pivot bar, said cross shaft being journaled for rotation between said bearings.

4. The exercise device of claim 1, wherein said handle includes pairs of inner and outer grips.

5. The exercise device of claim 1, wherein said footrests are tilted at a predetermined angle toward the rear end of said frame.

6. The exercise device of claim 1, further including:

means for adjustably securing said handle to said pivot bar.

7. The exercise device of claim 1, further including:

a longitudinal weight peg secured to the said other end of said pivot bar.

8. The exercise device of claim 1, wherein said frame includes a pair of laterally spaced apart side members, and further including:

a subframe secured between the side members of said frame, said footrests being mounted on said subframe.

9. The exercise device of claim 1, wherein said transverse weight tube is secured to said pivot bar in a predetermined raised position.

10. A T-bar row exercise device, which comprises:

a frame having front and rear ends;

an elongate pivot bar having opposite ends;

means for pivotally securing one end of said pivot bar to the rear end of said frame for pivotal movement in a vertical plane between lowered and raised positions;

a handle;

means for securing said handle to the other end of said pivot bar;

a transverse weight tube secured to said pivot bar between said handle and the rear end of said frame;

a pair of laterally spaced apart footrests associated with said frame and disposed on opposite sides of said pivot bar between said handle and said transverse weight tube;

stop means for normally supporting said pivot bar in the lowered position; and at least one primary free weight selectively positioned on said tube for biasing said pivot bar toward said stop means.

11. The T-bar row exercise device of claim 10, wherein the rear end is relatively wider than the front end of said frame.

12. The T-bar row exercise device of claim 10, wherein said means for pivotally securing one end of said pivot bar to said frame comprises:

a pair of laterally spaced apart bearings secured to said frame; and a cross shaft secured to said pivot bar, said cross shaft being journaled for rotation between said bearings.

13. The T-bar row exercise device of claim 10, wherein said handle includes pairs of inner and outer grips.

14. The T-bar row exercise device of claim 10, wherein said footrests are tilted at a predetermined angle toward the rear end of said frame.

15. The T-bar row exercise device of claim 10, further including:

a longitudinal weight peg secured to the said other end of said pivot bar; and at least one secondary free weight selectively positioned on said peg for additionally biasing said pivot bar toward said stop means.

16. The T-bar row exercise device of claim 10, wherein said frame includes a pair of laterally spaced apart side members, and further including:

a subframe secured between the side members of said frame, said footrests being mounted on said subframe.

17. The T-bar row exercise device of claim 10, wherein said transverse weight tube is positioned a predetermined vertical distance away from said pivot bar.

18. A T-bar row exercise device, which comprises:

a frame having front and rear ends;

an elongate pivot bar having opposite ends;

means for pivotally securing one end of said pivot bar to the rear end of said frame for pivotal movement in a vertical plane between lowered and raised positions;

a handle;

means for securing said handle to the other end of said pivot bar;

a transverse weight tube secured to said pivot bar between said handle and the rear end of said frame;

a pair of laterally spaced apart footrests associated with said frame and disposed on opposite sides of said pivot bar between said handle and said transverse weight tube;

stop means for normally supporting said pivot bar in the lowered position;

at least one primary free weight selectively positioned on said tube for biasing said pivot bar toward said stop means;

a longitudinal weight peg secured to the other end at said pivot bar; and at least one secondary free weight selectively positioned on said peg for additionally biasing said pivot bar toward said stop means.

19. The T-bar row exercise device of claim 18, wherein said handle is adjustable secured to said pivot bar, and wherein said footrests are tilted downwardly at a predetermined angle toward the rear end of said frame.

20. The T-bar row exercise device of claim 14, wherein said transverse weight tube is configured and secured to said pivot bar such that said primary free weight is supported a predetermined vertical distance away from said pivot bar.

* * * * *